United States Patent [19]

Cecere

[11] 4,088,175

[45] May 9, 1978

[54] VACUUM-FED CENTRIFUGAL CASTING MACHINE

[75] Inventor: Anthony Cecere, Hicksville, N.Y.

[73] Assignee: Alfred G. Pertot, Merrick, N.Y.

[21] Appl. No.: 587,456

[22] Filed: Jun. 16, 1975

[51] Int. Cl.[2] ..... B22D 27/16; B22D 13/10

[52] U.S. Cl. ..... 164/63; 164/65; 164/114; 164/133; 164/157; 164/254; 164/289; 164/326

[58] Field of Search ..... 164/61, 63, 84, 157, 164/290, 296, 326, 4, 156, 65, 133, 254, 256, 257, 258, 114; 141/8, 51; 266/239

[56] References Cited

U.S. PATENT DOCUMENTS

| | | | |
|---|---|---|---|
| 2,397,512 | 4/1946 | Schwartz et al. | 266/239 X |
| 2,808,856 | 10/1957 | Tiano et al. | 141/51 X |
| 2,829,408 | 4/1958 | Shuck | 164/290 X |
| 3,558,121 | 1/1971 | Lenne | 164/63 X |
| 3,752,214 | 8/1973 | Pertot | 164/156 |
| 3,862,656 | 1/1975 | Weiler et al. | 164/258 X |

*Primary Examiner*—Francis S. Husar

*Assistant Examiner*—Gus T. Hampilos

*Attorney, Agent, or Firm*—Wolder, Gross & Yavner

[57] ABSTRACT

A centrifugal casting machine includes a plurality of split centrifugal molds which are successively brought to a casting station in which the molds are closed, clamped together and rotated rapidly while molten metal is fed through a central sprue to mold cavities therein. For feeding the molten metal, a vacuum chamber is provided at the casting station above the mold, and a feed pipe leading to a reservoir of molten metal extends into the vacuum chamber through a nozzle which discharges into a funnel communicating with the central sprue of the mold. Means are provided to create a vacuum condition within the vacuum chamber, the funnel, nozzle and the mold cavities when the mold is closed and clamped, whereby the molten metal is drawn by a siphoning action through the feed pipe and discharged from the nozzle into the mold cavities. The feed flow of the molten metal is accomplished solely by the vacuum condition which is timed to feed a selected charge of molten metal to the mold cavities.

10 Claims, 3 Drawing Figures

VACUUM-FED CENTRIFUGAL CASTING MACHINE

BACKGROUND OF THE INVENTION

The present invention relates to improvements in casting equipment, and in particular to a novel and improved automatic centrifugal casting machine.

Conventional centrifugal casting machines are utilized for making small metal castings of ornamental jewelry and the like, these machines having one or more horizontal split rubber molds to which molten metal is fed through a central sprue to interval mold cavities, and the mold is rapidly rotated to distribute the metal into the cavities during the casting process. The molten metal may either be fed by manual operation of a ladle or crucible as disclosed in U.S. Pat. No. 3,280,434 or may be fed automatically through actuation of a valve to permit a measured amount of molten metal to flow through a nozzle into the interior of the mold as disclosed in U.S. Pat. No. 3,752,214. In both of these instances, the molten metal is gravity fed to the mold in a relatively slow process which increases the time of each molding cycle. In addition, the molten metal is not always uniformly distributed throughout the mold cavities to a degree which is required for fine, non-porous castings.

SUMMARY OF THE INVENTION

It is the principal object of the present invention to provide an improved centrifugal casting machine in which the molten metal is fed from the reservoir and distributed to the mold cavities by a vacuum condition created in the machine at the casting station.

Another object of the invention is the provision of a centrifugal casting machine of the character described in which the entire casting operation is performed automatically in a controlled sequence, and in which the vacuum pressure is applied for a timed period in order to draw a selected and precise charge of the molten metal from the reservoir and distribute it to the cavities of the rotating mold.

Still another object of the invention is to provide an automatic centrifugal casting machine of the character described in which the molten metal is drawn into the mold cavities by the vacuum pressure created therein, resulting in less porosity and greater density of the castings as well as an improved fineness and surface detail in the latter.

A further object of the invention is the provision of an automatic centrifugal casting machine of the character described in which the provision of the timed vacuum feed of the molten metal enables the casting to be done at reduced temperatures, resulting in a prolonged life for the rubber molds, and also reduces the time period for each molding cycle by a significant degree, thereby increasing the production output of the machine.

In accordance with the invention, there is provided a centrifugal casting machine comprising a centrifugal casting mold having a vertically disposed central sprue and a plurality of cavities communicating with said sprue, and means for rotating the mold about a central axis. Located above said mold is a vacuum chamber having a vertically extending funnel member which communicates with the mold sprue. A reservoir for molten metal is located in the machine remote from and below the level of the vacuum chamber, and a feed pipe, having one end immersed in the molten metal of the reservoir, leads to the upper portion of the vacuum chamber and has its other end connected to a vertically disposed nozzle which extends into the top of the funnel member. The machine also includes means for withdrawing air from the vacuum chamber so as to create a vacuum condition within said chamber, the vacuum condition extending to the nozzle, funnel, and mold cavities. The molten metal is thus drawn from the reservoir through the feed pipe by a vacuum siphoning action and discharged from the nozzle through said funnel member and through said sprue to said mold cavities, whereby the molten metal is distributed throughout said cavities by the vacuum condition therein.

In a preferred embodiment, the feed pipe is inclined upwardly from the reservoir to the vacuum chamber and the molten metal is drawn through the feed pipe by vacuum pressure until it reaches the vertically extending nozzle, through which it travels by force of gravity. The duration of the vacuum condition is controlled by a timer in synchronization with the casting cycle, and the duration is of such length to feed a selected charge of the molten metal to the mold cavities during each casting cycle.

Additional objects and advantages of the invention will become apparent during the course of the following specification when taken in connection with the accompany drawings.

BRIEF DESCRIPTION OF THE DRAWINGS

FIG. 3 is a central section, on an enlarged scale of a portion of the casting station shown in FIG. 2.

DESCRIPTION OF THE PREFERRED EMBODIMENT

Figure 1:
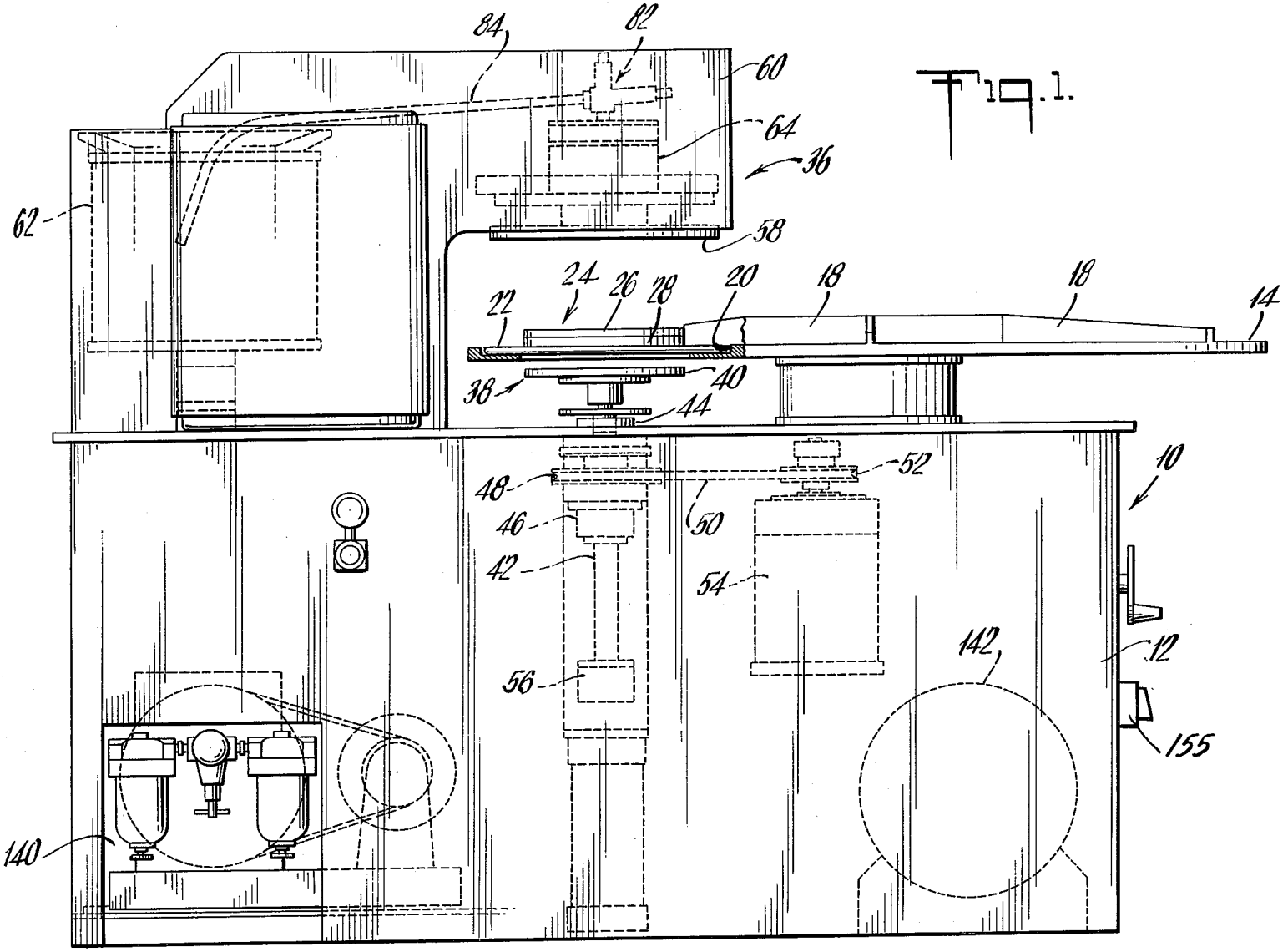
FIG. 1 is a side elevational view of an automatic casting machine made in accordance with the present invention, with interval portions thereof shown in phantom.

Referring in detail to the drawings, there is shown in FIG. 1 a portion of an automatic centrifugal casting machine 10 incorporating the improved mold charge feeding means of the present invention. The casting machine 10 is of the conventional turntable type such as is illustrated and described in U.S. Pat. No. 3,752,214. The casting machine includes a housing 12 which rotatably mounts a circular indexing table 14 supported by a shaft 16 which is journalled within the housing 12. A plurality of upstanding partition walls 18 divide the upper surface of the indexing table 14 into a series of segmented compartments, each of which contains a circular opening 20 within which is nested a circular mold support plate 22, one of which is illustrated in FIG. 1. Each plate 22 supports a rubber cylindrical mold 24 formed of separate upper and lower mold sections 26 and 28, the mating surfaces of which are formed to define a plurality of mold cavities 30 connected by radial runners 32 with a central sprue 34 in the mold top section 26, as shown in FIG. 3.

The casting machine 10 also includes a mold filling assembly 36 located above the indexing table 14, and drive means (not shown) is provided for automatically rotating the indexing table 14 at selected intervals through an angular distance sufficient to move one mold 24 out of alignment with the mold filling assembly 36 and to move the next succeeding mold 24 into alignment beneath the filling assembly 36. Located beneath the indexing table 14 and in vertical alignment with the filling assembly 36 is a mold clamping and spinning assembly 38 which is operative to lift the aligned mold support plate 22, and the mold 24 carried thereby, to an elevated position above the indexing table 14, clamp the mold sections 26 and 28 tightly together while the mold cavities are filled with molten metal, rotate the mold 24 rapidly to distribute the molten metal evenly to the cavities during the molding process, and then lower the mold 24 and its mold support plate 22 back onto the indexing table 14 and release the mold, so that the latter can be turned away from the filling assembly to removal of the molded articles from the mold.

The mold clamping and spinning assembly 38 includes a clamp plate 40 mounted upon a vertical shaft 42 which is journalled in suitable bearings 44 and 46 within the housing 12, through which the shaft 42 is also vertically slidable. The shaft 42 is also keyed to a pulley 48 connected by a belt 50 to a pulley 52 mounted on the drive shaft of an electric motor 54. The lower end of shaft 42 is connected to the piston of an air or hydraulic cylinder 56 by means of which it may be lifted and lowered.

The portions of the casting machine 10 described above are conventional and are shown and described in detail in the aforementioned U.S. Pat. No. 3,752,214. In operation of the machine, a closed empty mold 24 is placed on the support plate 22 of the segmented compartments of the indexing table 14. As a mold 24 is carried by the indexing table into alignment with the mold clamping and spinning assembly 38, the cylinder 56 is actuated to raise shaft 42, which elevates the clamp plate 40 and the mold 24 thereon to a position in which the mold is clamped tightly between the clamp plate 40 and a clamp plate 58 forming part of the overlying mold filling assembly 36. With the mold in clamped condition, the motor 54 rapidly rotates clamp plates 40, 58 and the mold 24. Molten metal is now fed to the interior of the mold 24 by the filling assembly 36, where the molten metal is distributed to the mold cavities 30 of the spinning mold. After a time interval, rotation of the mold is terminated, the clamp plate 40 is lowered and the indexing table is turned to bring the filled mold 24 to a location where it can be removed and replaced by an empty mold, and at the same time to bring the next suceeding mold into alignment with the filling assembly 36 for initiation of the next molding cycle.

The present invention is directed to the structure and operation of the mold filling assembly 36 which is mounted within an extension portion 60 of housing 12 which is upstanding from said housing and which overhangs the mold clamping assembly 38. Within the housing extension portion 60 is a reservoir 62 which contains a supply of molten metal to be fed in measured charges to the molds during the molding operation. The reservoir 62 is preferably provided with heat insulating walls and electric or gas heaters which maintain the contained metal in a molten state.

Forwardly of the reservoir 62 an enclosed hollow casing constituting a vacuum chamber 64 is secured to the wall of housing extension 60 immediately above and in line with the mold clamping assembly 38. The vacuum chamber casing 64 has a thick and sturdy top wall 66 secured thereon by bolts 68 and 70. Extending centrally through the top wall 66 is a tubular member 72 having a longitudinal bore 74 extending therethrough, the tubular member 72 being clamped to the top wall 66 by a pair of nuts 76 and 78 engaging the threaded ends of said tubular member. Extending through the tubular member 72 is a metal nozzle 80 which is connected through an angular coupling 82 to a feed pipe 84 for the molten metal to be supplied to the molds. The feed pipe 84 is made of metal, and as shown in FIG. 1, it extends from the angular coupling 82 to the interior of the reservoir 62 where it is immersed in the pool of molten metal within the reservoir. The feed pipe is disposed at an upward inclination from the top of the reservoir to the angular coupling 82. As shown in FIG. 3 the major portion of the feed pipe 84 is sheathed in an insulated covering 86, within which an electric heater coil 88 is wrapped around the feed pipe. The end portion of the heater coil 88 extends from the feed pipe to the metal nozzle 80 and is wrapped therearound. The heater coil 88 thus heats both the feed pipe 84 and the nozzle 80, maintaining the metal therein in a molten state. The tubular member 72 is made of heat-insulating material to contain the heat of the coil 88 surrounding nozzle 80, and prevent the transfer of this heat to the interior of vacuum chamber 64.

The lower end portion of the nozzle 80 projects outwardly of the tubular member 72 and is secured thereto by a weld 90 which also provides an air-tight seal over the mouth of the tubular member 72. The projecting lower end of the nozzle 80 extends into the top of a ceramic funnel member 92. A metal collar 94 surrounds the ceramic funnel member 92 and supports the latter, the collar 94 and funnel member 92 extending through openings in the bottom wall of vacuum chamber 64 and in the bottom wall of the housing extension portion 60. The lower end of the collar 94 supports the clamp plate 58 and is secured thereto by means of bolts 96. The upper end portion of the funnel member 92 is formed with a circumferential flange 98 upon which rests a circular pan 100 which prevents splashing of the molten metal fed by the nozzle 80 into the funnel member 92. A plurality of bolts 102 clamp the flange 98 between the pan 100 and a retaining ring 104 recessed within the body of collar 94, to attach the funnel member 92 rigidly to the collar.

The funnel member 92, collar 94 and pan 100 are thus connected as a rigid unit to the clamp plate 58 and are adapted to rotate in unison with the clamp plate 58, relative to the stationary vacuum chamber 64 and housing extension 60, when the clamp plate 58 is rotated by the rotating molds. To facilitate such rotation, a ball bearing assembly 106 is interposed between the clamp plate 58 and a block 108 secured to the bottom wall of housing extension 60 by bolts 110. An annular frictionless bearing 112 is recessed in the bottom wall of the vacuum chamber 64 and underlies the retaining ring 104 to permit free rotation thereof.

A sealing ring 114 is mounted in the bottom wall of housing extension 60 surrounding the opening therein, and engages the collar 94 to provide an air-tight sliding seal against the rotating collar to prevent the escape of the vacuum within the vacuum chamber. The block 108 is drilled at one side to provide a series of interconnected oil passage bores 116, 118 and 120. An oil feed pipe 122, connected to a source of lubricating oil (not shown) communicates with the bore 166 to supply lubrication therethrough to the sealing ring 114, and through the bore 120 to the ball bearing assembly 106.

The angular coupling 82 is formed with a pair of legs 124 and 126 which are disposed at an angle of slightly less than 90° with relationship to each other. The legs 124 and 126 have respective through longitudinal bores 128 and 130 which cross each other in the manner shown in FIG. 3 and continue to open through the opposite walls of the coupling 82. The major portion of the bores within the legs 124 and 126 are filled with respective plugs 132 and 134 having screw-threaded portions 136 and 138 which permit the plugs to be removed for clearing of the bore passageways. The molten metal feed pipe 84 is connected to the coupling 82 in alignment with and in communication with the bore 130, while the nozzle 80 is connected to the coupling 82 in alignment with and in communication with the bore 128.

Figure 2:
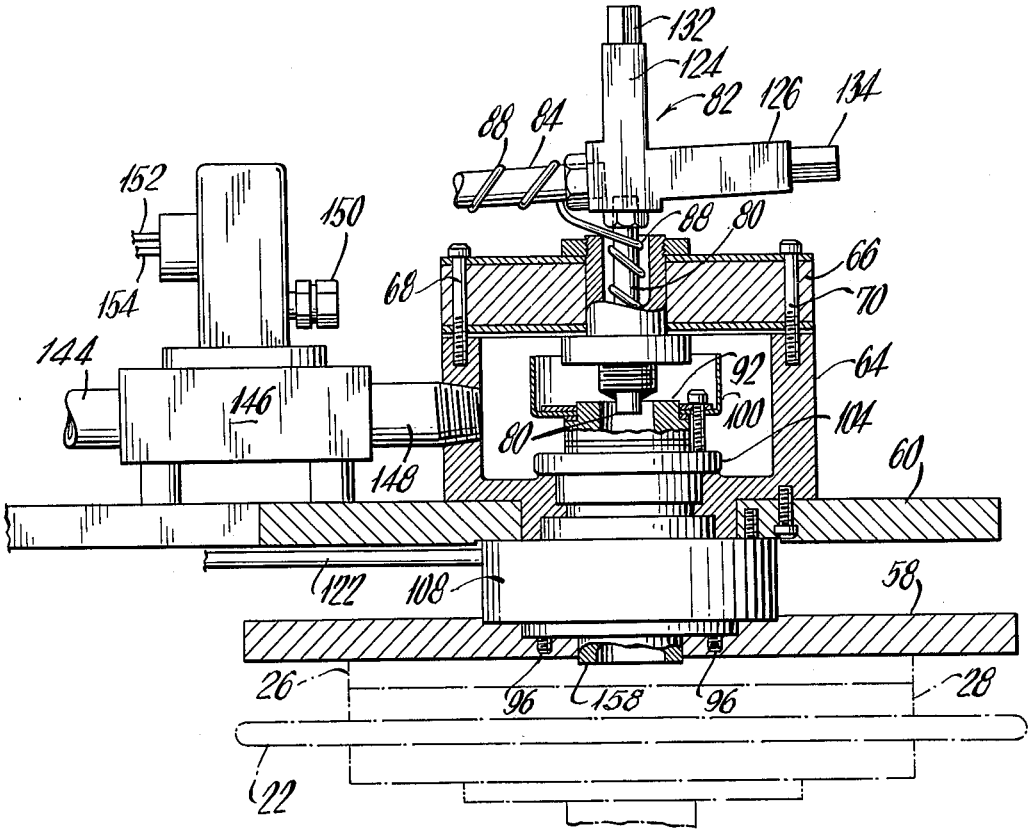
FIG. 2 is a side elevational view on an enlarged scale of the casting station of the machine of FIG. 1, with portions thereof broken away and shown in section.
Figure 5:
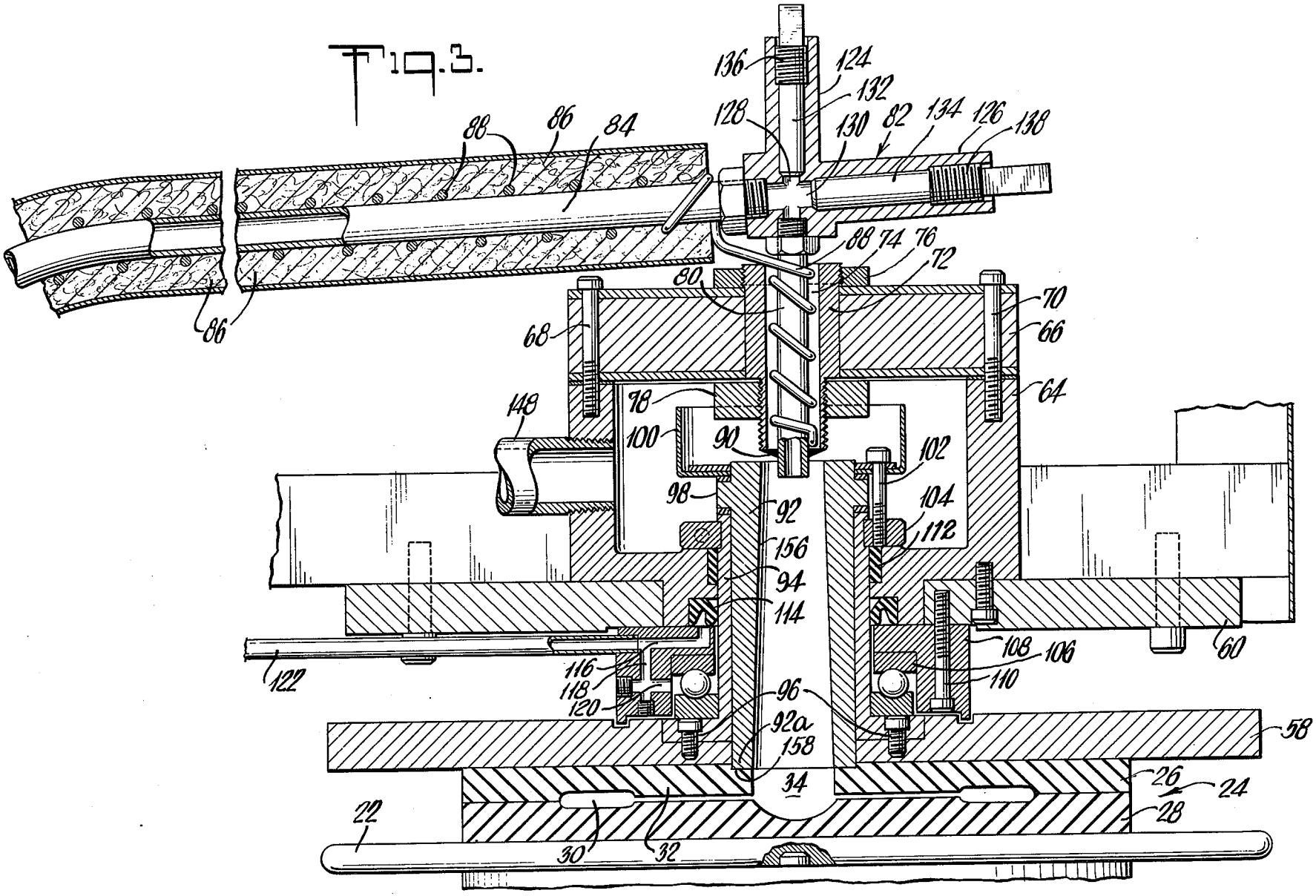

A vacuum condition within the vacuum chamber 64 is provided by a vacuum pump 140 connected to a vacuum holding tank 142 (FIG. 1). A pipe 144 (FIG. 2) connects the vacuum holding tank 142 through an air-actuated electrical solenoid valve 146 to a metal pipe 148 leading to the interior of the vacuum chamber 64. Operation of the solenoid valve 146 is controlled by an air pilot 150 connected to the pneumatic system of the machine in such a manner that the solenoid valve is normally closed, but when the mold sections 26 and 28 are closed and clamped together, air pressure fed to the air pilot 150 causes the solenoid valve 146 to open and create a vacuum condition within the vacuum chamber 64 and within the cavities of said molds. A pair of leads 152 and 154 connect the solenoid valve 146 to an electrical timer 155 on the front panel of the machine, which timer is set for a short time interval during which the vacuum condition is maintained, after which the timer closes the solenoid valve 146.

The ceramic funnel member 92 has a central longitudinal bore 156 which is tapered, being wider at its bottom end than at its top end. The bottom end **92*a* of the funnel member 92 projects slightly below the under surface of the clamp plate 56, and when the mold sections 26 and 28 are elevated by the mold support plate 22 into engagement with said clamp plate 56, the projecting bottom end 92*a* of the funnel member 92 is received within a shallow recess 158 in the upper surface of the mold section 26, as shown in FIG. 3. In this condition, the bottom end of the funnel member bore 156 registers with the central sprue 34 of the closed mold sections 26 and 28**.

As the mold sections are closed and clamped, the solenoid valve 146 is opened, causing air to be withdrawn from the interior of the vacuum chamber 64, creating a vacuum condition therein as well as in the bore 156 and the mold runners 32 and cavities 30 which communicate therewith. At pressures up to fifteen inches of vacuum, the vacuum force is too small to attract the molten metal through tube 84, and the withdrawal of air through tube 148 is directed solely to the evacution of the vacuum chamber and mold cavities. As the vacuum increases to above fifteen inches, it begins to draw the molten metal from the reservoir 62 upwardly through the inclined feed pipe 84, and at a pressure of about twenty-seven to twenty-eight inches of vacuum, the molten metal enters the angular coupling 82 and reaches the point of juncture of the upwardly inclined bore 130 with the vertical bore 128. At this point the molten metal feeds through the nozzle 80 into the funnel 92 by the attraction of the created vacuum assisted by the force of gravity.

The molten metal passes through the funnel 92, enters the sprue 34, and is fed through the runners 32 to the mold cavities 30, all of which are under vacuum conditions to insure that the molten metal is evenly distributed therein as the mold sections 26 and 28 are rotated rapidly. After a short period of time, constituting about one-half of the entire molding cycle, a static condition is reached in which the mold flow ceases. At about this time, the aforementioned timer is set to close the solenoid valve 146 and halt the evacuation of air.

It will thus be appreciated that the molten metal is fed from the reservoir 62 in a siphoning action and that the volume of metal fed is controlled by the timed vacuum condition created. Because of the vacuum condition in the mold cavities, the metal is distributed therein with greater density and greatly reduced porosity, resulting in an improved casting. In addition, the vacuum condition enables the temperature of the molten metal to be reduced by at least 100° F, so that the metal can be cast at a temperature of approximately 450° F, which is not possible in other machines of this type. Thicker pieces may thus be cast at much lower temperatures, resulting in significant energy savings. In addition, by raising the temperature, castings may be produced with a fineness of detail surface quality and thin wall sections hitherto unattainable in conventional casting machines. The casting at lower temperatures also increases the durability of the rubber molds, prolonging their effective life before they are required to be replaced.

A particular advantage of the timed vacuum feed of the molten metal is that it eliminates the necessity of mechanical feeding of the metal through ladles or other devices, and thereby reduces the duration of the molding cycle. In conventional machines where the molten metal is fed by manual operation of a ladle, the molding cycle for a single mold requires approximately one and one-half minutes. In conventional machines where the metal is automatically nozzle-fed without vacuum, the molding cycle is about one minute. In the vacuum feed system of the present invention, the evacuation and mold filling time is reduced to approximately one-half second and the total spin and set time is reduced to about ten to twelve seconds for most jewelry items. This permits the machine to operate at a rate of casting four molds per minute with two men working, resulting in a great increase in the productive capacity of the machine, with a molded product of improved quality.

While a preferred embodiment of the invention has been shown and described herein, it is obvious that numerous omissions, changes and additions may be made in such embodiment without departing from the spirit and scope of the invention.

I claim:

1. A centrifugal casting machine comprising a circular indexing table disposed on a horizontal plane, a plurality of centrifugal casting molds supported in uniformly-spaced relationship about the upper surface of said indexing table, means operatively associated with said table for rotating said indexing table periodically to bring each of said molds successively to a casting station, each centrifugal casting mold having a top-open vertically-disposed central sprue and a plurality of cavities communicating with said sprue, means operatively associated with each mold at the casting station for clamping each mold in closed condition when said mold is brought to said casting station and for rotating said mold about a central axis, a vacuum chamber located on a horizontal plane above said casting station and having an upper end and a vertically-extending funnel member mounted therein and projecting from the bottom end thereof and adapted to be brought into airtight communication with said sprue when said mold is clamped in closed condition, a reservoir for molten metal located in said machine at a position remote from said vacuum chamber and located on a horizontal plane below the level of the horizontal plane of said vacuum chamber, a feed pipe having a first end immersed in said reservoir and leading to the upper portion of said vacuum chamber the inlet of the feed pipe being located in a position such that metal cannot flow into the feed pipe without the creation of a vacuum within the pipe, a vertically-disposed nozzle connected to the second end of said feed pipe and extending into the top of said funnel member within said vacuum chamber, and means for creating a vacuum condition within said vacuum chamber when each mold is clamped in closed condition and is rotated, with said vacuum condition extending to said nozzle, funnel and said mold cavities, whereby the molten metal is drawn from said reservoir through said feed pipe by a vacuum siphoning action, and discharged directly through said funnel member and communicating sprue to said mold cavities when said mold cavities are closed and under vacuum condition.

2. A centrifugal casting machine according to claim 1 in which said molten metal is distributed throughout said cavities by the vacuum pressure therein.

3. A centrifugal casting machine according to claim 1 in which said feed pipe extends at an upward inclination from said reservoir to said vacuum chamber, the vacuum condition in said vacuum chamber being sufficient to draw molten metal upwardly through said feed pipe to the second end thereof, the molten metal then descending through said vertically-disposed nozzle under force of gravity.

4. A centrifugal casting machine according to claim 3 in which said feed pipe is connected to said nozzle by an angular coupling having an upwardly-inclined bore connected to said feed pipe and communicating with a vertically-extending bore connected to said nozzle.

5. A centrifugal casting machine according to claim 1 which also includes vacuum pump means connected to said vacuum chamber for withdrawing air therefrom whereby to create said vacuum condition within said vacuum chamber.

6. A centrifugal casting machine according to claim 5 in which a solenoid valve is interposed between said vacuum pump means and said vacuum chamber, and timing means is connected to said solenoid valve for operating the latter at selected intervals, whereby to regulate the duration of the vacuum condition within said vacuum chamber.

7. A centrifugal casting machine according to claim 1 in which said mold is supported by a rotatable support plate and is pressed thereby against a rotatable clamp plate secured to said funnel member, said rotating means being coupled to said support plate for rotating the latter, whereby said mold and said funnel are rotated relative to said vacuum chamber and said nozzle.

8. A centrifugal casting machine according to claim 7 in which sealing means are mounted between said vacuum chamber and said funnel for maintaining the vacuum condition within said vacuum chamber during rotation of said funnel.

9. A method for centrifugally casting molten metal in a rotary mold having internal mold cavities, comprising the steps of elevating the rotary mold into sealing engagement with a vertically-disposed funnel located beneath a nozzle and within a vacuum chamber surrounding both the funnel and nozzle which is connected to a source of molten metal located remote from said nozzle via a supply pipe, maintaining the level of molten metal in the source of molten metal at a horizontal level below the horizontal level of an entrance to the nozzle with the nozzle communicating through said funnel with the internal mold cavities rotating said mold, introducing a vacuum pressure in said chamber about said nozzle and within said funnel with said vacuum pressure extending into said mold cavities, said vacuum pressure being of sufficient force to draw molten metal upwardly by a siphoning action from said source to said nozzle, and timing the duration of said vacuum pressure for such a time period as to feed a selected charge of molten metal from said nozzle through said funnel to said mold cavities.

10. A method according to claim 9 in which said vacuum pressure is introduced in said mold cavities simultaneously to its introduction about said nozzle and funnel.

* * * * *